US005383582A

United States Patent [19]

Baxter et al.

[11] Patent Number: 5,383,582

[45] Date of Patent: Jan. 24, 1995

[54] SIFT-RESISTANT DISPENSING CLOSURE

[75] Inventors: David C. Baxter, Southington; Michael J. Forsyth, Stow, both of Ohio

[73] Assignee: Weatherchem Corporation, Twinsburg, Ohio

[21] Appl. No.: 210,690

[22] Filed: Mar. 18, 1994

[51] Int. Cl.[6] ..... B65D 47/00

[52] U.S. Cl. ..... 222/548; 222/480

[58] Field of Search ..... 222/480, 548, 555, 565

[56] References Cited

U.S. PATENT DOCUMENTS

| | | | |
|---|---|---|---|
| 2,817,451 | 12/1957 | Giles et al. | 222/548 X |
| 2,928,577 | 3/1960 | Hoffman | 222/555 |
| 2,954,148 | 9/1960 | Corrinet et al. | 222/548 X |
| 2,961,133 | 11/1960 | Ankney | 222/548 |
| 2,971,681 | 2/1961 | Galbierz | 222/548 |
| 3,100,589 | 8/1963 | Love, Jr. | 222/548 X |
| 3,260,426 | 7/1966 | Ayotte | 222/548 X |
| 3,463,364 | 8/1969 | Rehag | 222/480 |
| 3,467,287 | 9/1969 | Marchant | 222/480 |
| 3,486,665 | 12/1969 | LaCroce | 222/480 |
| 4,299,339 | 11/1981 | Giroux et al. | 222/153 |
| 4,611,725 | 9/1986 | Kacalieff | 222/480 X |
| 4,969,572 | 11/1990 | vankerhoven | 222/548 X |
| 5,058,778 | 10/1991 | Weinstein | 222/555 X |
| 5,176,277 | 1/1993 | Schuermann | 222/548 X |

FOREIGN PATENT DOCUMENTS

| | | | |
|---|---|---|---|
| 27133 | 12/1956 | Germany | 222/555 |
| 996022 | 6/1965 | United Kingdom | 222/548 |
| 1576126 | 10/1980 | United Kingdom | 222/548 |

*Primary Examiner*—Kevin P. Shaver

*Attorney, Agent, or Firm*—Pearne, Gordon, McCoy & Granger

[57] ABSTRACT

A rotor-style sift-resistant dispensing closure of injection-molded thermoplastic having a base that provides a resilient seal on its dispensing hole and a rotor carried on the base in a position that compresses the seal for sealing effectiveness. The rotor is accurately maintained in a flat configuration by the base which retains the rotor both at its center and at its periphery and which stabilizes the rotor against distortion with upstanding supporting ribs situated between the center and periphery of the rotor.

14 Claims, 2 Drawing Sheets

Fig1
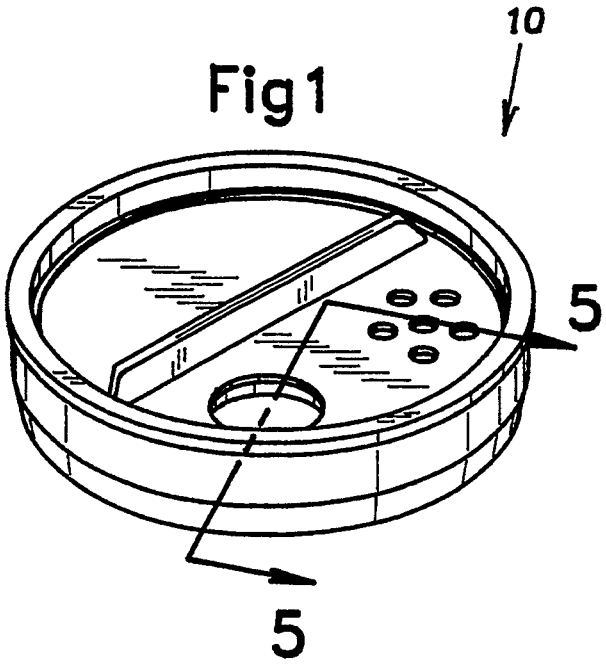
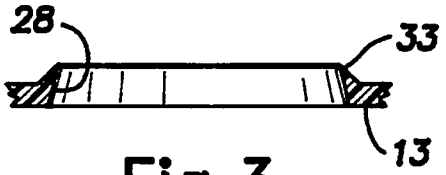
Fig.3
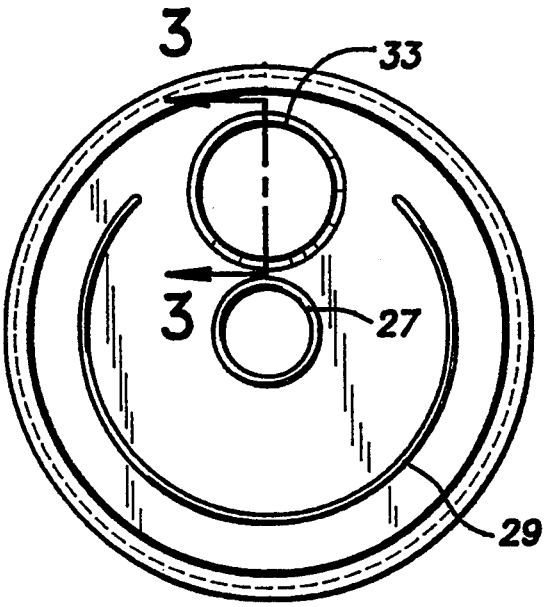
Fig.2
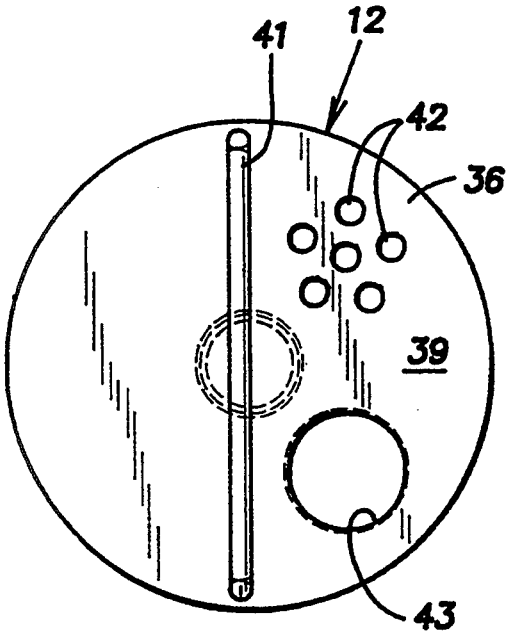
Fig.4

SIFT-RESISTANT DISPENSING CLOSURE

BACKGROUND OF THE INVENTION

The invention relates to injection-molded thermoplastic dispensing closures and, in particular, to closures of the rotor and base type.

PRIOR ART

Fine powders, such as baby powder and talcum powder are notoriously difficult to package in containers with sift or sprinkle dispensing features. This problem involves the tendency of the powder to sift or escape out of the dispensing closure openings when the package is handled from the point of filling to the ultimate point of use by a consumer. Typically, this unintended sifting or escaping of product while not significant in terms of the volume of the contents of the package, is detrimental to the appearance of the product package on the retailing shelf. Good shelf presentation is especially important in the cosmetic and health care industries. Commonly, the unintended sifting occurs even though the closure is assembled in a closed position and is not operated until after it is purchased by the consumer.

Talcum powder and the like has been packaged in composite containers having two-part rotor-type plastic closures. One part comprises a rotor and the other part comprises a base for the rotor fixed to an opening of the container. The rotor is turned between positions where any dispensing apertures in the base are covered by the rotor so that the closure is closed and where one or more apertures in the base is uncovered by an aperture in the rotor turned into alignment with this base aperture. It has been attempted to seal the base aperture against the overlying rotor surface with an annular ridge around the base aperture. Customarily, rotor and base closures have been offered in either of two styles of rotor and base connections. In one style, the rotor is rotatably fixed at its center by a post and in the other styles the rotor is rotatably fixed at its periphery to the base. In one closure in the prior art, it is attempted to retain the rotor on the base with a post integral with the center of the rotor that snaps into a blind hold in the base and to simultaneously retain the rotor on the base with a depending skirt on the rotor that catches in an undercut in the base below the main central web of the base.

SUMMARY OF THE INVENTION

The invention provides a rotor-type dispensing closure having improved sift resistance resulting from a novel combination of a resilient seal and structural elements that maintain the rotor in a flat closely held position relative to the base and its seal. As disclosed, the rotor is retained by the base both at its outer periphery and at its center area. The resilient seal projects upwardly from the base and contacts the lower face of the rotor. The base retains the rotor in an axial position where it compresses the resilient seal to a degree where a reliable seal is assured.

Concentric rib formations on the base compliment the peripheral and central restraints of the base on the rotor and reduce any tendency of the rotor to distort from an ideal plane by bending or like deformation. The disclosed concentric ribs comprise an inner rib adjacent the center of the rotor and an arcuate rib, terminating on opposite sides of the base dispensing hole, at a radius from the rotor center that describes a circle which intercepts the base dispensing hole. The ribs with the peripheral and central restraint impart a high level of confinement to the rotor while avoiding excessive friction which could otherwise hinder manual rotation of the rotor and thereby detract from user acceptance.

BRIEF DESCRIPTION OF THE DRAWINGS

FIG. 1 is a perspective view of a closure assembly embodying the invention;

FIG. 2 is a plan view of the base of the closure assembly;

FIG. 3 is an enlarged fragmentary view of a dispensing hole area of the base taken in the plane 3—3 in FIG. 2;

FIG. 4 is a plan view of a rotor of the closure assembly; and

DESCRIPTION OF THE PREFERRED EMBODIMENT

Figure 5:
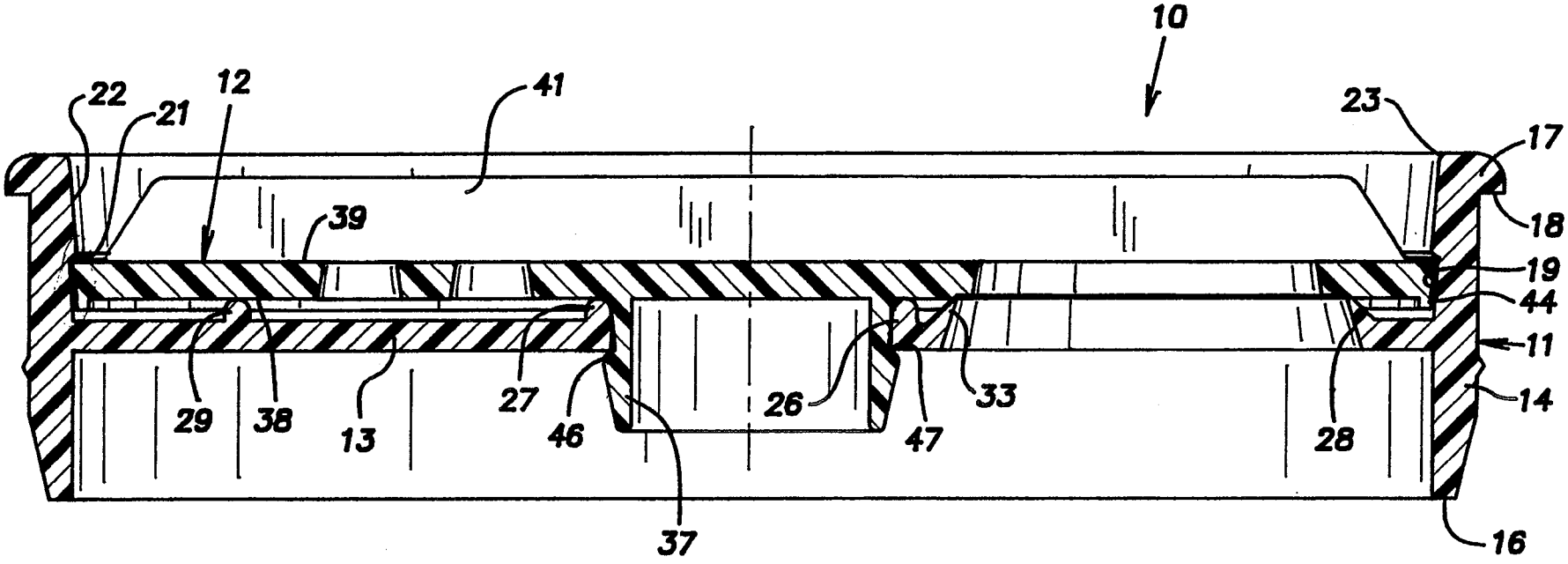
FIG. 5 is a cross-sectional elevational view of the closure assembly taken along staggered planes indicated by the lines 5—5 in FIG. 1.

A closure 10 constructed in accordance with the invention includes a base 11 and a rotor 12 each preferably injection molded of a suitable thermoplastic material such as polyethylene. The illustrated closure 10 is particularly suited for use with composite containers known in the art. The base 11, which in the illustrated case is generally circular, includes a central web 13 and a peripheral rim 14 integrally molded around the web. The rim 14 has the general form of a cylindrical wall. The web 13 is a generally circular planar construction that lies in a plane perpendicular to the axis of the rim 14.

At its lower end, the base rim or skirt 14 is tapered so that it has a reduced outside diameter, at a minimum at its lower edge 16, to facilitate its assembly into a container. At its upper end, the rim 14 includes an outwardly directed radial flange 17 that forms a radial shoulder 18 adapted to abut the upper edge of a composite cylindrical container in a conventional manner. On its interior, the rim 14 is formed with an internal circumferential groove or recess 19 above the web 13 and bounded by a conical or radial face 21. Above this face 21, an interior surface 22 of the rim 14 is tapered slightly radially outwardly increasing in diameter with increasing distance from the web 13 preferably so that at its upper end 23 the rim 14 has an internal diameter at least as large as the major diameter of the rotor 12.

At its center, the web 13 has a circular hole 26 extending therethrough. Concentric with the hole 26, is an upstanding rib 27 having a rounded or semi-circular cross-section (FIG. 5). In the wed 13 radially between the hole 26 and rim 14 is a dispensing opening 28 which in the illustrated example is circular in form.

A second upstanding rib 29 concentric with the center hole 26 extends on the web 13 over an arc subtending an angle that is sufficient to allow its ends 31, 32 to lie adjacent the dispensing opening or hole 28 (FIG. 2). In the illustrated example, this arcuate length is approximately 270°. The arcuate rib 29 has a cross-section and height above the web 13 substantially the same as the central rid 27. It will be understood that these ribs 27, 29 have their axially upper regions in a common imaginary plane that is closely dimensionally located with respect to the undercut or groove surface 21. At its upper side, the dispensing opening 28 has an integral sealing lip 33 that is relatively resilient due to a reduced thickness wall section compared to the average wall thickness of the base 11. In its free state, the sealing lip 33 extends above the ribs 27 and 29 a substantial distance.

The rotor 12 has a circular main body or disc 36 with a central hollow hub or post 37 depending from its lower face designated 38. On an upper face 39 the rotor 12 includes an upstanding chordal finger grip bar 41 to facilitate manual turning of the rotor 12 on the base 11. The rotor 12 is imperforate except for an array of sift holes 42 and a pour hole 43. The array of sift holes 42 and the pour hole 43 have the same eccentricity or distance from the center of the rotor 12 as the dispensing hole 28 has from the base center hole 26 so that these holes 42 or 43 can be alternatively turned into superadjacent alignment with the dispensing hole 28 by manually rotating the rotor 12 on the base 11. A depending flange 44 is formed adjacent the periphery of the rotor 12 at its lower face 38. The flange 44, particularly when the rotor 12 is gated for molding purposes at its periphery, serves to improve molding performance and during use serves to stiffen and maintain the desired flat shape of the rotor. The bottom or underside surface 38 of the rotor 12 is substantially flat between the flange 44 and the hub 37. As shown in FIG. 5, the axial extent of the flange 44 is less than the height of the base ribs 27, 29 so that the flange, when the rotor is assembled on the base, does not touch the web 13.

The hub 37 is a thin walled round structure depending from the center of the bottom or lower face 38 of the rotor 12. The lower end of the hub 37 is slightly tapered on its exterior from a minimum diameter slightly less than that of the base hole 26 to facilitate assembly into this hole. In its free state, the hub 37 has a major outside diameter at its mid-section 46 that is greater than the diameter of the hole 26 enabling the hub 37 to be snapped into the hole. Once it is pressed or snapped into the hole 26, the hub 37 is retained in assembly by a rearwardly or upwardly facing annular shoulder 47 that engages the lower edge of the hole 26. Preferably, the outside diameter of the hub 37 above the shoulder 47 is slightly smaller than the diameter of the hole 26 to reduce friction between these areas.

The major outer diameter of the rotor 12 is dimensioned to snap past the internal rim shoulder formed by the conical or radial face 21 on the rim 14 into the groove formed between it and the web 13. Typically, the rotor 12 is automatically assembled on the base by a machine known in the art. It can be seen in FIG. 5 that, in assembly, the rotor 12 is retained on the base 11 both at its center and at its periphery. The retention at the center is produced by the interengagement or abutment between the hub shoulder 47 and the lower edge of the hole 26. The retention at the outer periphery of the rotor is provided by interengagement or abutment between the upper face of the rotor 39 and the shoulder 21. The various elements of the base 11 and rotor 12 are proportioned and dimensioned so that the ribs 27, 29 hold the rotor in a flat plane with the upper peripheral rotor edge urged against the rim shoulder 21 and, simultaneously, the hub shoulder 47, urged against the underside of the rotor 12 by the resilient sealing lip 33.

The closure 10 is initially assembled with the rotor 12 in an angular position on the base where it closes the dispensing hole 28, a condition that results when neither the sift holes 42 nor the pour hole 43 overlie the dispensing hole 28. In this closed position, the resilient lip seal 33 around the dispensing hole 28 forms a tight sift proof seal with the flat underside surface of the rotor 12. The disclosed ribs 27, 29 working with the center and peripheral retention points maintain precise control of the flatness of the rotor 12 to improve the integrity and reliability of the sift proof seal. The arcuate rib 29, as mentioned, subtends an angle greater than 180° (as shown in FIG. 2) and preferably extends with its ends adjacent the base dispensing hole 28. This construction greatly reduces any tendency of the rotor 12 to rock, flex, or otherwise significantly distort from a planar configuration parallel to the plane of the base web 13. This, in turn, assures that the lip seal 33 has a flat parallel surface against which it can reliably seal. The various parts are dimensioned so that when the rotor and base are assembled, the lip seal 33 is substantially compressed. By way of example, where the base 11 is a nominal 1 7/8 diameter and the lip seal in a free condition prior to its assembly has a height above the web of about 0.066 inch it can be restricted or compressed to a height of, for example, 0.030 to 0.035 inch by the restriction imposed by the flat underside 38 of the rotor. Preferably, the elevation of the tops of the ribs 27, 29 provides a limited axial clearance of, for example, 0.005 inch for adjacent confronting parts of the rotor. This clearance assures smooth sliding contact of the rotor on the base when it is manually opened or closed by rotation. Ideally, this clearance is substantially smaller than the axial compression of the lip seal 33 so that slight dimensional variations in the actual parts inherent in mass production injection molding processes have no significant effect on the reliability of the seal afforded by the lip seal.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A sift resistant dispensing closure formed of injection molded thermoplastic material comprising a base and a rotor assembled on the base, the base including a peripheral rim for attachment adjacent an opening in the container and a central generally planar web radially inward of the rim for extending across the container opening, the rotor having a generally planar disc-like main body with a circular outer periphery and a central zone, a retaining area on the base surrounding and supporting the outer periphery of the rotor in an assembled position on the base in which the rotor main body overlies the base central web, the retaining area supporting the periphery of the rotor against axial movement away from the underlying base central web, a hub for retaining the central zone of the rotor in the assembled position on the base, the base retaining area and hub permitting rotation of the rotor on the base about its center, a dispensing opening in the base web disposed radially between the rim and the hub, a resilient lip seal surrounding the dispensing opening and engaging an underside surface of the rotor main body, the rotor main body having at least one dispensing opening selectively alignable with or displaceable from the base dispensing opening by manual rotation of the rotor on the body, the retaining area and the hub both restraining the rotor for rotation in the plane of the main body and in an accurately maintained axial location where its underside surface compresses the lip seal a predetermined distance to assure a sift resistant seal therewith at angular positions of the rotor on the base where the dispensing openings are out of alignment.

2. A closure as set forth in claim 1, wherein the rim extends above a plane of the rotor main body and it provides said retaining area.

3. A closure as set forth in claim 1, wherein the base web includes a circular rib concentric with said hub axially supporting said rotor in its assembled position.

4. A sift resistant dispensing closure formed of injection molded thermoplastic material comprising a base and a rotor assembled on the base, the base including a peripheral rim for attachment adjacent an opening in the container and a central web radially inward of the rim for extending across the container opening, the rotor having a disc-like main body with a circular outer periphery and a central zone, a retaining area on the base surrounding and supporting the outer periphery of the rotor in an assembled position on the base in which the rotor main body overlies the base central web, a hub for retaining the central zone of the rotor in the assembled position on the base, the base retaining area and hub permitting rotation of the rotor on the base about its center, a dispensing opening in the base web disposed radially between the rim and the hub, a resilient lip seal surrounding the dispensing opening and engaging an underside surface of the rotor main body, the rotor main body having at least one dispensing opening selectively alignable with or displaceable from the base dispensing opening by manual rotation of the rotor on the body, the retaining area and the hub restraining the rotor for rotation in the plane of the main body and in an axial location where its underside surface compresses the lip seal to assure a sift resistant seal therewith at angular positions of the rotor on the base where the dispensing openings are out of alignment, and including an upstanding arcuate rib concentric with the hub and proportioned to support the rotor main body at a radius from its center generally equal to the distance of the base dispensing opening in the hub.

5. A closure as set forth in claim 4, wherein the arcuate rib is integral with the base.

6. A sift resistant dispensing closure formed of injection molded thermoplastic material comprising a base and a rotor assembled on the base, the base including a peripheral rim for attachment adjacent an opening in the container and a central web radially inward of the rim for extending across the container opening, the rotor having a disc-like main body with a circular outer periphery and a center, cooperating retaining elements on the base and rotor supporting the rotor in an assembled position on the base in which the rotor main body overlies the base central web, the retaining elements permitting rotation of the rotor on the base about its center, a dispensing opening in the base web disposed radially between the rim and the center of the rotor, a resilient lip seal surrounding the dispensing opening and engaging an underside surface of the rotor main body, the rotor main body having at least one dispensing opening selectively alignable with or displaceable from the base dispensing opening by manual rotation of the rotor of the body, the retaining elements restraining the rotor for rotation in the plane of the main body and in an upwardly limited axial location where its underside compresses the lip seal to assure a sift resistant seal therewith at angular positions where the dispensing openings are out of alignment, an arcuate rib concentric with the center of the rotor enabling the base central web to support the rotor along an arc that is spaced from the center of the rotor a distance substantially equal to the distance from the center of the rotor to the dispensing opening in the base web, the arcuate rib reducing the tendency of the rotor main body to deflect downwardly out of a generally planar configuration and thereby assure that the sealing effectiveness of the lip seal is maintained.

7. A closure as set forth in claim 6, wherein the rib lies on an imaginary circle defined by a radius that extends radially from the center of the hub substantially to the dispensing opening in the base inch, the rib having an axial height enabling it to support the rotor in a plane and an axial location that limits the compression of the resilient seal.

8. A closure as set forth in claim 7, wherein the rib extends along an arc that is greater than 180°.

9. A closure as set forth in claim 8, wherein said rib extends along an arc that is about 270°.

10. A closure as set forth in claim 6, wherein the rotor includes an integral hub.

11. A closure as set forth in claim 10, wherein the web has a hole to receive the hub of the rotor.

12. A closure as set forth in claim 11, wherein the web has an integral circular rib surrounding and adjacent the hole, the circular rib cooperating with the arcuate rib to support the rotor in a manner limiting downward displacement of the rotor on the base.

13. A closure as set forth in claim 6, wherein the retaining elements include, on the base, a retainer surface for restraining the periphery of the rotor.

14. A closure assembly as set forth in claim 13, wherein the rotor has a depending flange on its lower side adjacent its outer periphery.

* * * * *